US007153171B1

(12) United States Patent
Goto

(10) Patent No.: US 7,153,171 B1
(45) Date of Patent: Dec. 26, 2006

(54) LAMP SOCKET WITH STABILIZING FEATURES

(75) Inventor: Kazuhiro Goto, Markham (CA)

(73) Assignee: Tyco Electronics Canada, Ltd., Markham (CA)

( * ) Notice: Subject to any disclaimer, the term of this patent is extended or adjusted under 35 U.S.C. 154(b) by 0 days.

(21) Appl. No.: 11/220,147

(22) Filed: Sep. 6, 2005

(51) Int. Cl.
*H01R 24/00* (2006.01)

(52) U.S. Cl. ..... 439/699.2

(58) Field of Classification Search ..... 439/699.1, 439/669.2, 619

See application file for complete search history.

(56) References Cited

U.S. PATENT DOCUMENTS

| | | | | |
|---|---|---|---|---|
| 4,902,251 | A * | 2/1990 | Grzena | 439/699.2 |
| 5,197,187 | A | 3/1993 | Thomas | |
| 7,014,510 | B1 * | 3/2006 | Powers et al. | 439/699.2 |
| 2003/0068929 | A1 | 4/2003 | Powers et al. | |
| 2004/0132336 | A1 | 7/2004 | Powers et al. | |
| 2005/0227541 | A1 * | 10/2005 | Garcia et al. | 439/619 |

* cited by examiner

*Primary Examiner*—Tho D. Ta

(57) ABSTRACT

A lamp socket includes a housing having a lamp receiving side and a wire receiving side. The lamp receiving side includes a lamp receptacle configured to receive the lamp assembly when inserted in a lamp insertion direction. The wire receiving side includes a contact receptacle. A contact is mounted in the contact receptacle in the housing. The contact includes a mating end for electrically and mechanically engaging the lamp assembly. The mating end includes a first side wall and an end wall joined to one another along a bend that extends along a longitudinal axis of the contact. The longitudinal axis extends in a direction non-perpendicular to the insertion direction. The first side wall has a planar surface that extends along a vertical plane. The planar surface engages the lamp assembly continuously along a length of the planar surface in a direction parallel to the longitudinal axis of the contact and to the lamp insertion direction. The lamp socket further includes a retainer having a first end mounted in the housing and a second end configured to engage a groove formed in the lamp holder to retain the lamp holder in the housing.

19 Claims, 9 Drawing Sheets

LAMP SOCKET WITH STABILIZING FEATURES

BACKGROUND OF THE INVENTION

This invention relates generally to a lamp socket, and more specifically, to a lamp socket that stabilizes a lamp or bulb within the socket.

A most basic requirement of the many different vehicle lamp socket designs in use today, is the requirement that the lamp socket secure the lamp against damage, including damage from vibration that occurs during operation of the vehicle. At least some lamp sockets retain the lamp in a manner that allows for an amount of lateral lamp movement within the socket. Such lateral movement of the lamp within the socket is undesirable in that it adversely affects the interface between the lamp lead wires and the lamp socket contacts and is a common source of failure in the lighting system. In one approach to retaining a wedge base lamp, U.S. Pat. No. 5,197,187 describes a lamp socket wherein the terminal contacts include beams that retain a lamp base in the socket. U.S. Published Patent Application 20040132336 and its parent, Published Application 20030068929 describe lamp sockets that include features that, in conjunction with terminal contacts, align, stabilize, and retain the lamps in the sockets.

A shortcoming associated with the aforementioned socket designs is that the terminal contacts alone do not provide sufficient stability for the lamp. As a result, these designs rely on features in the plastic socket housing, such as flexible supports, to provide bulb stabilization. Over time, loss of contact pressure, and fretting corrosion due to plastic retainer softening may compromise the bulb stabilization features of the housing, and may also bring about lamp failure. These effects are accelerated when the socket is exposed to lamp operating temperatures. Some socket designs also incorporate a retainer mechanism to facilitate stabilization of the lamp. But, the retainers typically provide only a point engagement with the lamp, and thus, are not particularly effective.

A need remains for a cost effective lamp socket that provides lamp retention, and lamp stabilization that render the lamp socket suitable for use in the often harsh environment associated with motor vehicle lighting.

BRIEF DESCRIPTION OF THE INVENTION

In one aspect, a lamp socket for holding a lamp assembly is provided. The lamp socket includes a housing having a lamp receiving side and a wire receiving side. The lamp receiving side includes a lamp receptacle configured to receive the lamp assembly when inserted in a lamp insertion direction. The wire receiving side includes a contact receptacle. A contact is mounted in the contact receptacle in the housing. The contact includes a mating end for electrically and mechanically engaging the lamp assembly. The mating end includes a first side wall and an end wall joined to one another along a bend that extends along a longitudinal axis of the contact. The longitudinal axis extends in a direction non-perpendicular to the insertion direction.

Optionally, the first side wall has a planar surface that extends along a plane. The planar surface engages the lamp assembly continuously along a length of the planar surface in a direction parallel to the longitudinal axis of the contact and to the lamp insertion direction. The lamp socket further includes a retainer having a first end mounted in the housing and a second end configured to engage a groove formed in the lamp holder to retain the lamp holder in the housing. The contact includes a ground contact and a pair of power contacts. The ground contact receives a portion of the lamp within the side walls. The power contacts are positioned adjacent one another so that a portion of the lamp is received between adjacent side walls of the pair of power contacts.

In another aspect, a lamp socket for holding a lamp assembly includes a housing having a lamp receiving side and a wire receiving side. The lamp receiving side includes a lamp receptacle configured to receive the lamp assembly when inserted in a lamp insertion direction. The wire receiving side includes a contact receptacle. A contact is mounted in the contact receptacle in the housing. The contact includes a mating end and a wire receiving end. The mating end includes a first side wall and an end wall joined to one another along a bend that extends along a longitudinal axis of the contacts. The longitudinal axis extends in a direction non-perpendicular to the lamp insertion direction. One of the side wall and end wall includes a mounting panel that is received in the contact receptacle to mount the contact. The mounting panel includes a necked down portion from which the wire receiving end extends.

In yet another aspect, a lamp and socket assembly is provided that includes a lamp assembly including a lamp holder having an end panel and a housing having a lamp receiving side and a wire receiving side. The lamp receiving side includes a lamp receptacle configured to receive the lamp assembly when inserted in a lamp insertion direction. The wire receiving side includes a contact receptacle. A contact is mounted in the contact receptacle in the housing. The contact includes a mating end for electrically and mechanically engaging the lamp assembly. The mating end includes a first side wall and an end wall joined to one another along a bend that extends along a longitudinal axis of the contact. The longitudinal axis extends in a direction non-perpendicular to the insertion direction.

DETAILED DESCRIPTION OF THE INVENTION

Figure 1:
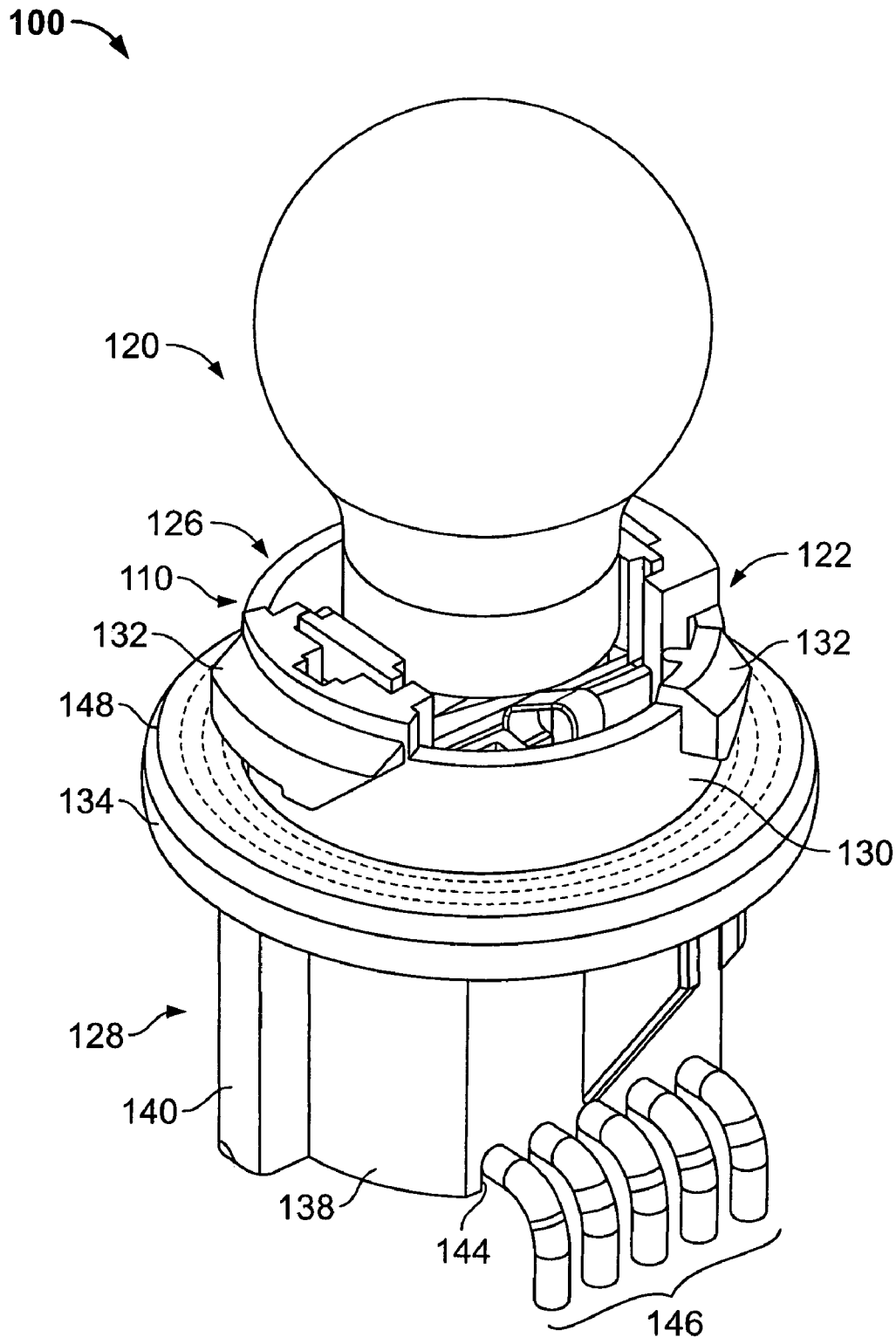
FIG. 1 is a perspective view of a lamp and socket assembly formed in accordance with an exemplary embodiment of the present invention.

FIG. 1 is a perspective view of a lamp and socket assembly 100 formed in accordance with an exemplary embodiment of the present invention. While the lamp and socket 100 will be described with particular reference to a vehicle lighting system, it is to be understood that the benefits herein described are also applicable to other applications in alternative embodiments. The following description is therefore provided for purposes of illustration, rather than limitation, and is but one potential application of the inventive concepts herein.

The lamp and socket assembly 100 includes a lamp socket 110 and a lamp assembly 120 that is mounted in the lamp socket 110. The lamp socket 110 includes a housing 122 that has a lamp side 126 and a wire side 128. The lamp side 126 has an outer shell 130 that has a plurality of lugs 132 formed thereon. A mounting flange 134 separates the lamp side 126 and the wire side 128 of the housing 122. The wire side 128 includes an outer shell 138. A plurality of tabs 140 are formed on the wire side outer shell 138. A plurality of wire guide channels 144 are formed in the wire side outer shell 138 to permit the entry of wires 146 into a wiring cavity 340 (FIG. 8) in the interior of the wire side 128 of the housing 122. A sealing gasket 148 is positioned on the mounting flange 134.

Figure 2:
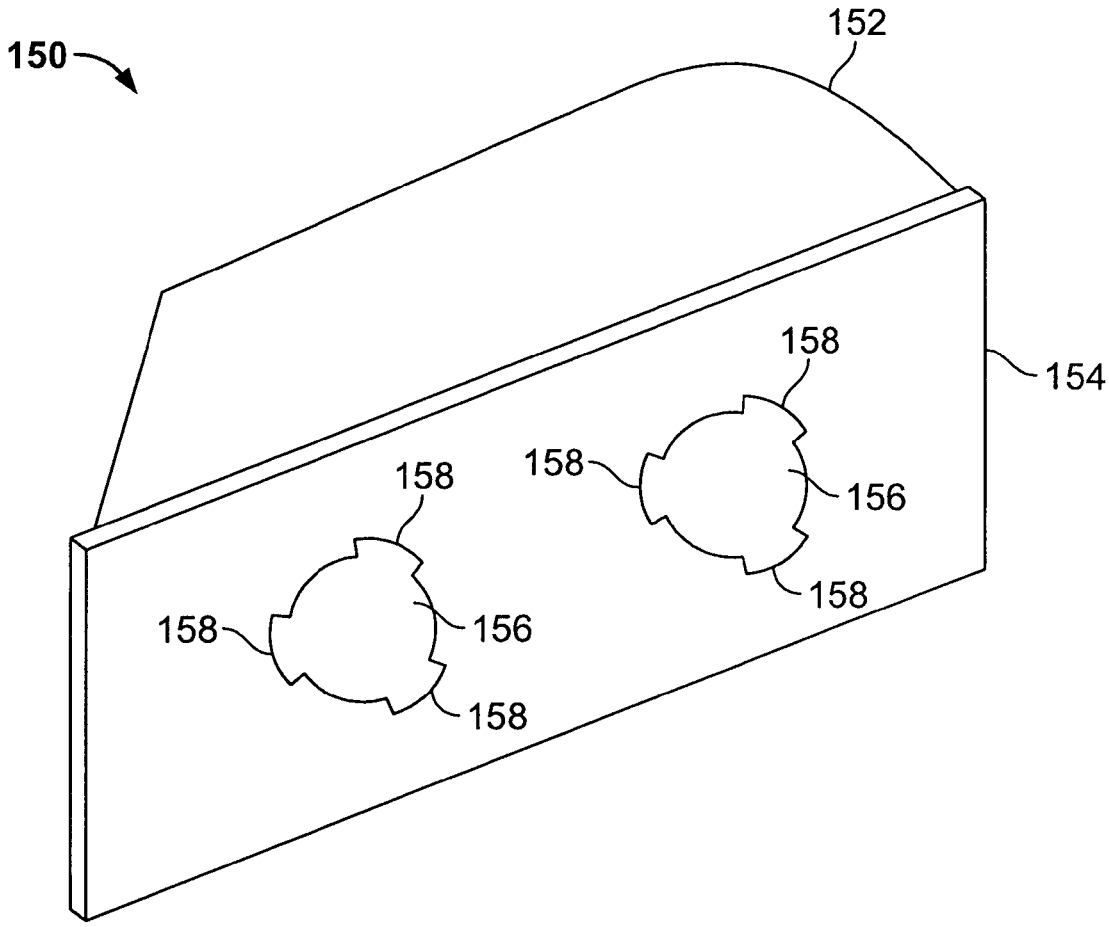
FIG. 2 (Prior Art)
FIG. 2 illustrates a known lamp housing.

FIG. 2 illustrates a known lamp housing 150 as may be used on a motor vehicle in a vehicle lighting system. The lamp and socket assembly 100, in one embodiment, may be mounted in the lamp housing 150, for use in the vehicle lighting system. The lamp housing 150 is typically fabricated from a plastic material and has an exterior reflecting cover 152 and a socket mounting plate 154 with mounting holes 156. The reflecting cover 152 and the socket mounting plate 154 cooperate to form a lamp chamber (not shown) in the interior of the reflecting cover 152.

The lamp side 126 of the socket housing 122 is configured to be received into the lamp chamber (not shown) of the lamp housing 150 at an insertion position with the lugs 132 passing through cutouts 158 extending from the mounting holes 156. Rotation of the lamp and socket assembly 100 about one quarter of a turn from the insertion position brings the lugs 132 into engagement with an interior surface (not shown) of the socket mounting plate 154 such that the lugs 132 retain the lamp and socket assembly 100 in the lamp housing 150. When rotated to retain the lamp and socket assembly 100, the lugs 132 also generate a compressive load on the sealing gasket 148 to seal the lamp housing. In some embodiments, the lugs 132 and the interior surface of the socket mounting plate 154 may include complementary features that cooperate to lock the lamp and socket assembly 100 in place in the lamp housing 150. The tabs 140 are provided to facilitate rotation of the lamp and socket assembly 100. Rotation is typically in a clockwise direction, however in some embodiments, the lugs 132 and the socket mounting plate may be configured for counterclockwise rotation of the lamp and socket assembly 100.

A sealing gasket 148 is provided on the mounting flange 134 to seal the mounting hole 156 to prevent the entry of moisture and debris into the lamp chamber. In one embodiment, the lamp and socket assembly 100 may be a W-2.5 type wedge based lamp and socket assembly.

Figure 3:
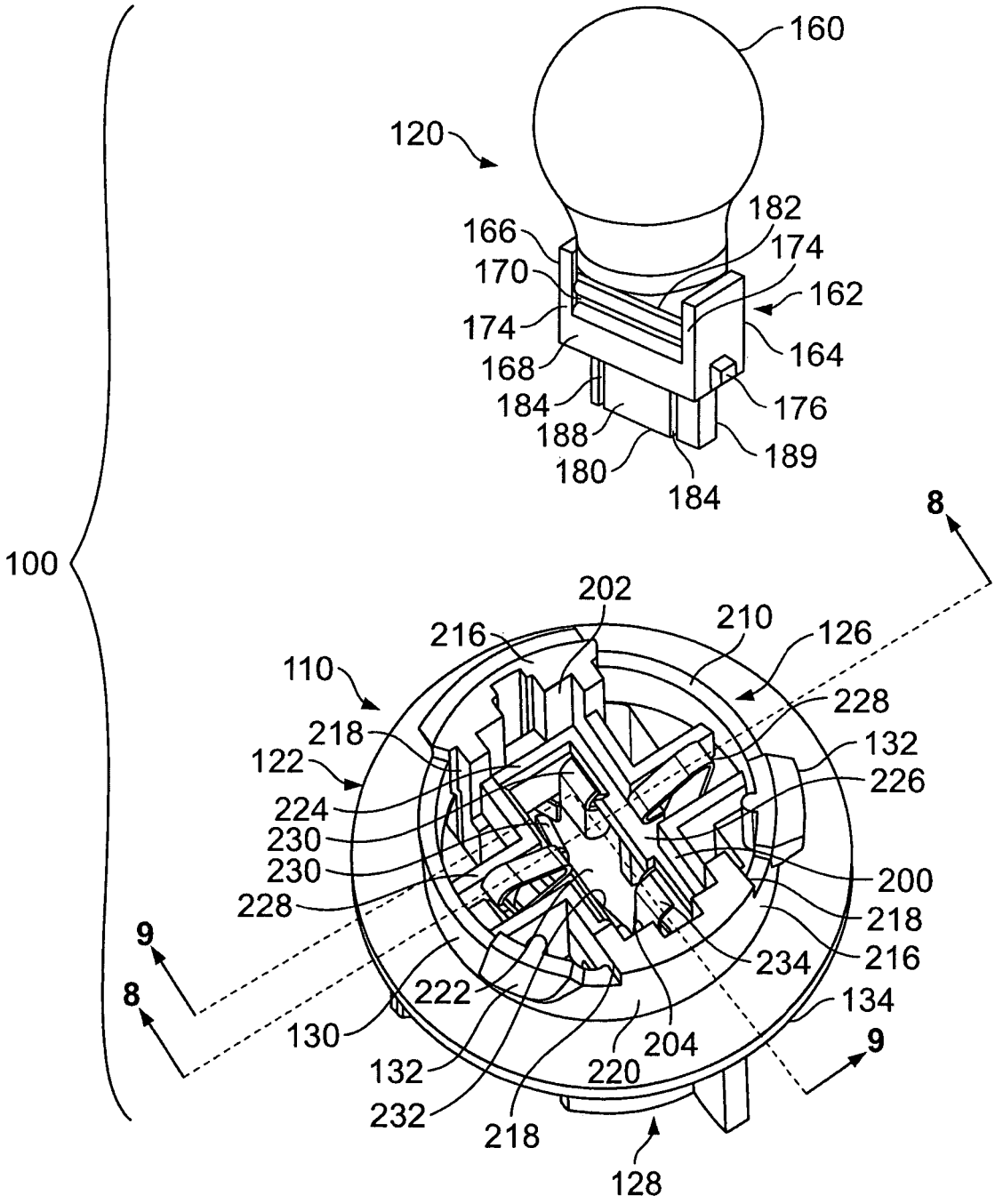
FIG. 3 is an exploded view of the lamp and socket assembly shown in FIG. 1.

FIG. 3 is an exploded view of the lamp and socket assembly 100. The lamp assembly 120 is a known assembly that includes a lamp or bulb 160 that upwardly extends from a lamp holder 162. The lamp holder 162 includes a first end panel 164 and a second end panel 166 that extend from a cross member 168. The lamp 160 is positioned between the end panels 164 and 166 and rests on the cross member 168. The cross member 168 includes a groove 170 on opposite sides of the cross member 168 between the end panels 164 and 166. The end panels 164 and 166 each include side edges 174 and a tab 176 centrally positioned between the side edges 174. The lamp 160 includes an integrally formed extension 180 that extends downwardly through a slot 182 formed in the cross member 168. Electrical contacts 184 are located on surfaces 188 and 189 of the lamp extension 180. The contacts 184 are electrically connected to one or more filaments (not shown) within the lamp 160.

The housing 122 of the lamp socket 110 is fabricated from a dielectric material and in an exemplary embodiment is a unitary structure that comprises the lamp side 126, the wire side 128, and the flange 134. The outer shell 130 of the lamp side 126 is substantially cylindrical and encloses a lamp receptacle 200 that receives the lamp holder 162 of the lamp assembly 120. The lamp receptacle 200 includes first and second guide channels 202 and 204, respectively, that are substantially diametrically opposed on opposite sides of the housing 122 within the outer shell 130. In one embodiment, the guide channels 202 and 204 extend above an upper rim 210 of the outer shell 130. The guide channels 202 and 204 each receive one of the end panels 164, 166 of the lamp holder 162 when the lamp assembly 120 is inserted into the lamp socket 110. Each guide channel 202, 204 includes an end wall 216 and a pair of opposed side walls 218. In one embodiment, the outer surfaces of the end walls 216 are coextensive with an outer surface 220 of the outer shell 130.

The lamp receptacle 200 includes a bottom opening 222 bounded by end walls 224 and side walls 226. A retainer 228 is provided on each side of the lamp receptacle 200. The retainers 228 are centrally positioned between end walls 224. The retainers 228 engage the groove 170 on the lamp holder 162 to facilitate stabilization of the lamp holder 162 in the housing 122. Terminal contacts 230, 232, and 234 are loaded into the wiring contact cavity 340 (see FIG. 8) in the wire side 128 of the housing 122.

Figure 4:
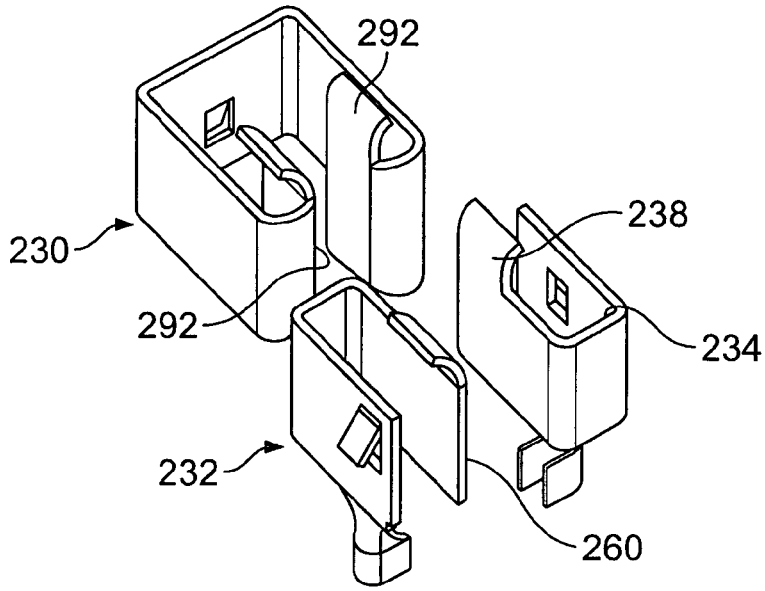
FIG. 4 is a perspective view of the contacts shown in FIG. 3.

FIG. 4 illustrates the terminal contacts 230, 232, and 234 removed from the housing 122. Terminal contacts 230, 232, and 234 are used in groups of three as shown in FIG. 4. The terminal contact 230 is a ground contact. The ground contact 230 provides a common ground for all of the filament circuits in the lamp assembly 120. The terminal contacts 232 and 234 are separate power contacts that deliver current to the filament circuits within the lamp assembly 120. More specifically, the terminal contacts 230, 232, and 234 support the presence of two filament circuits within the bulb 160, which identifies the bulb 160 as a two-filament bulb. The power terminal contacts 232 and 234 are identical to one another, but oppositely oriented with respect to one another in the housing 122. One end of the lamp extension 180 is received within the ground terminal contact 230 and is held between engagement surfaces 292. The opposite end of the lamp extension 180 is received between the separate power terminal contacts 232 and 234 and is held between engagement surfaces 260 and 238, as will be described. The terminal contacts 230, 232, and 234 are dual function contacts in that the contacts 230, 232, and 234 provide the primary stabilization of the lamp assembly 120 in the socket housing 122.

Figure 5:
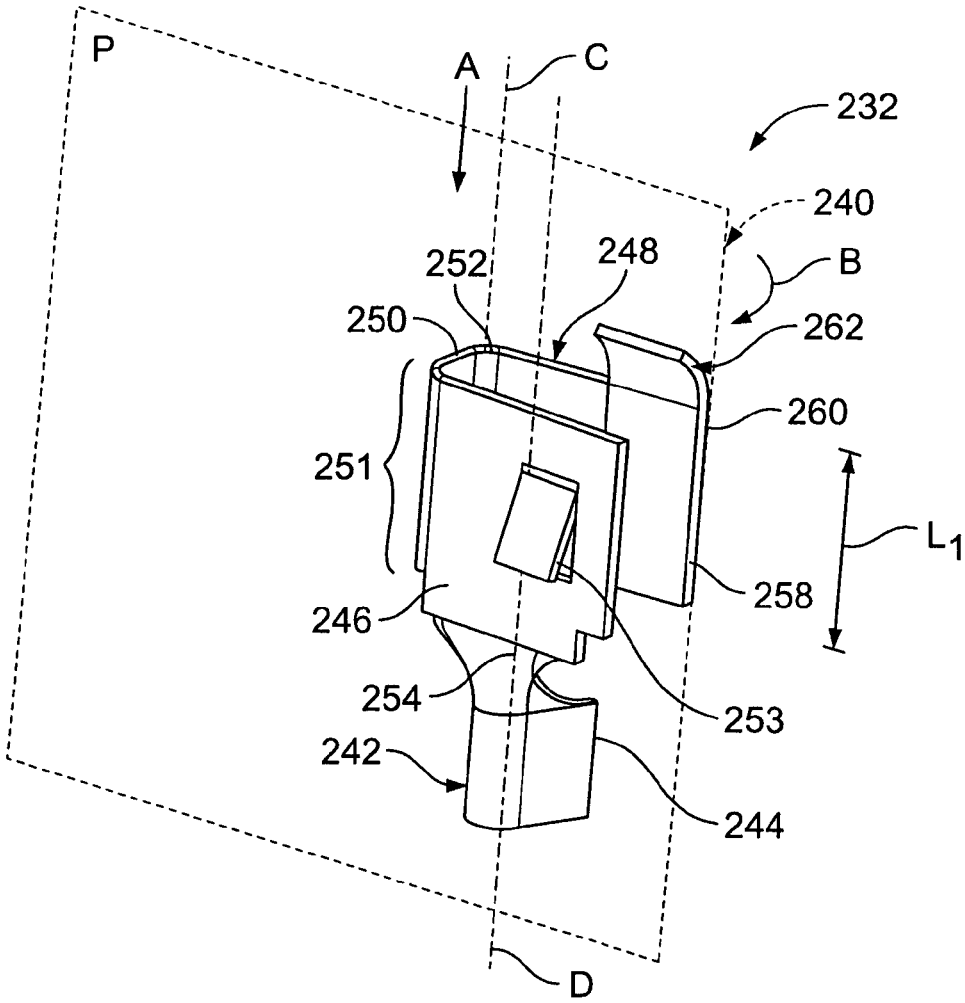
FIG. 5 is a perspective view of a power contact formed in accordance with an exemplary embodiment of the present invention.

FIG. 5 is a perspective view of the power contact 232. The power contact 234 is identical to the power contact 232, and will not be separately described. The power contact 232 includes a mating end 240 and a wire receiving end 242. The wire receiving end 242 includes crimping tabs 244 that may be crimped to a wire. The power contact 232 includes a first side wall 246 and an opposed second side wall 248. An end wall 250 joins the first and second side walls 246 and 248, respectively at bends 251 and 252. At least one of the side walls 246, 248 includes a tab 253 configured to engage a ledge 356 (FIG. 9) on the housing 122 to retain the power contact 232 in the housing 122. One of the side walls 246, 248 comprises a mounting panel and includes a necked down portion 254 from which the wire receiving end 242 extends.

The second side 248 includes a contact engagement section 258 having an outward facing planar contact surface 260 that extends along a vertical plane P. The engagement section 258 has an arcuate extension 262 formed thereon. The arcuate extension 262 curves toward the first side wall 246. The arcuate extension 262 engages the lamp extension 180 (FIG. 3) to guide the lamp extension 180 into engagement with the contact surface 260. The contact engagement section 258 has a length $L_1$. The power contact 232 is used in adjacent pairs 232 and 234 that are oriented opposite with respect to one another (see FIG. 4) such that when the lamp holder 162 is fully inserted into the housing 122, the lamp extension 180 is received between two power contacts 232 and 234. The pair of power contacts 232, 234 cooperate to engage the lamp extension 180 so that the contact surfaces 260, 238 (FIG. 4) of the power contacts 232, 234 engage the lamp extension surfaces 188 and 189 (FIG. 3) substantially over their entire length $L_1$. The power contacts 232, 234 provide electrical connections to the lamp circuits and also stabilize the lamp assembly 120 in the housing 122.

When inserted into the socket 110, the lamp assembly 120, including the lamp extension 180 is moved in a lamp insertion direction, indicated by the arrow A, to move the lamp extension 180 into engagement with the contacts 232 and 234. As the lamp extension 180 moves into engagement with the side wall 248, side wall 248 is deflected inwardly through an arc generally indicated by the arrow B such that the side wall pivots about a pivot axis C. The pivot axis C is substantially parallel to a longitudinal axis D through the contact 232.

Figure 6:
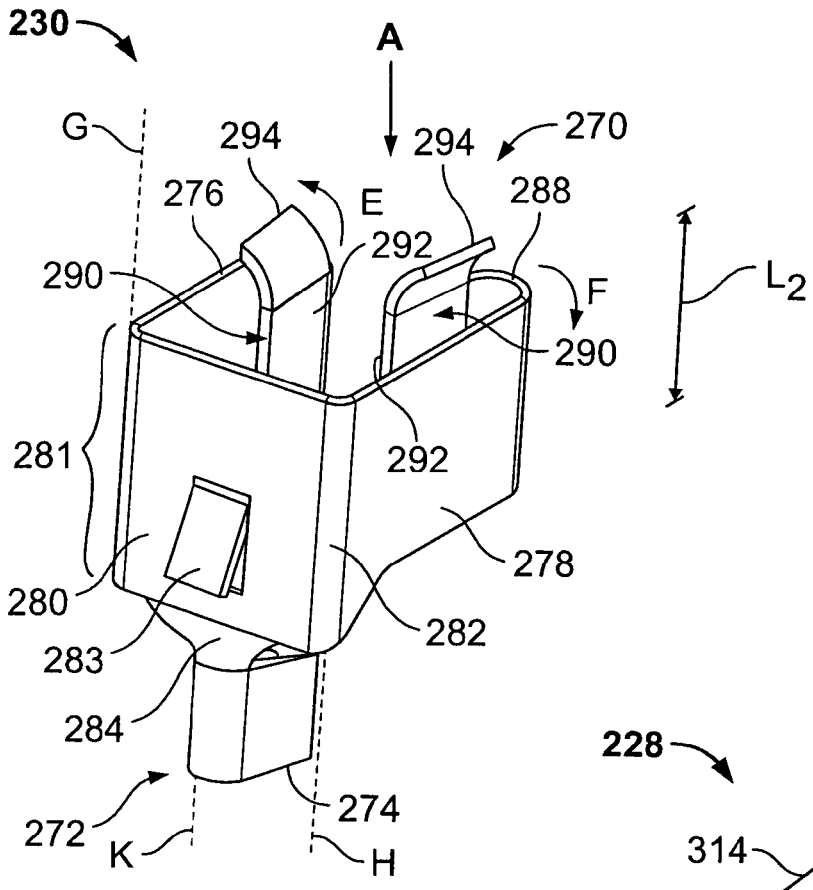
FIG. 6 is a perspective view of a ground contact formed in accordance with an exemplary embodiment of the present invention.

FIG. 6 is a perspective view of the ground contact 230. The ground contact 230 includes a mating end 270 and a wire receiving end 272. The wire receiving end 272 includes crimping tabs 274 that may be crimped to a wire. The ground contact 230 includes a first side wall 276 and an opposed second side wall 278. An end wall 280 joins the first and second side walls 276 and 278, at bends 281 and 282 respectively. At least one of the side walls 276, 278 and the end wall 280 includes a tab 283 configured to engage a ledge 358 (FIG. 9) on the housing 122 to retain the ground contact 230 in the housing 122. One of the side walls 246, 248 and the end wall 280 comprises a mounting panel that also includes a necked down portion 284 from which the wire receiving end 272 extends.

Each side wall 276 and 278 includes an arcuate portion 288 from which a contact engagement section 290 extends. The arcuate sections 288 are curved inwardly, toward one another so that the contact engagement sections 290 face each other and are positioned between the side walls 276 and 278. Each contact engagement section 290 includes an inwardly facing contact surface 292. Each contact engagement section 290 includes an arcuate extension 294 formed thereon. The arcuate extensions 294 curve outwardly. The arcuate extensions 294 engage the lamp extension 180 (FIG. 3) to guide the lamp extension 180 into engagement with the contact surfaces 292 into an engaged position between the side walls 276 and 278. The contact sections 290 have a length $L_2$. When the lamp holder 162 is fully inserted into the housing 122, the contact surfaces 292 engage the lamp extension 180 substantially over their entire length $L_2$. As with the power contacts 232, the ground contact 230 provides electrical connections and also stabilizes the lamp assembly 120 in the housing 122. The ground contact 230 is used with pairs of power contacts 232 as depicted in FIG. 4 with the ground contact 230 positioned proximate one of the end walls 224 (FIG. 3) and the pair of power contacts 232 positioned proximate the other end wall 224.

As indicated above, when inserted into the socket 110, the lamp assembly 120, including the lamp extension 180 is moved in the lamp insertion direction A, to move the lamp extension 180 into engagement with the contacts 230. As the lamp extension 180 moves into engagement with the contact surfaces 292 of the contact sections 290, the side walls 276 and 278 are deflected outwardly through arcs E and F respectively. In so doing, the side wall 276 pivots about a pivot axis G while the side wall 278 pivots about a pivot axis H. The pivot axes G and H are substantially parallel to a longitudinal axis K through the contact 230.

Figure 7:
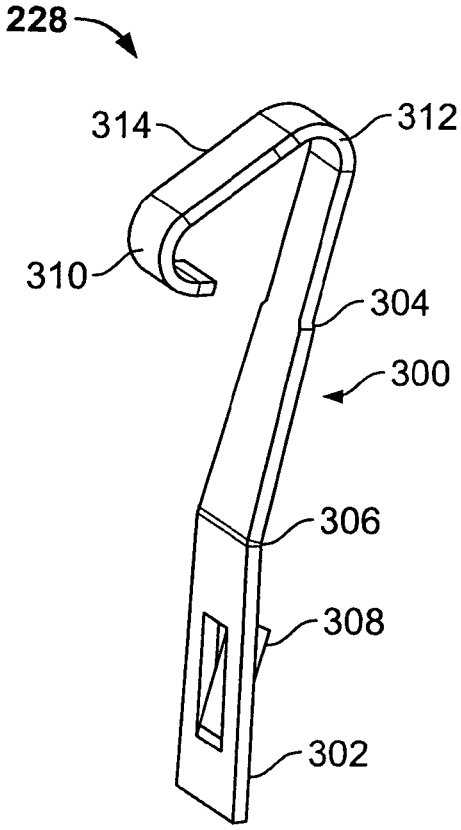
FIG. 7 is a perspective view of a retainer formed in accordance with an exemplary embodiment of the present invention.

FIG. 7 is a perspective view of the retainer 228 that includes a retainer body 300 that has a mounting end 302 and a main body 304 formed with a first bend 306 with the mounting end 302. The mounting end 302 includes a tab 308 configured to engage a ledge 348 (FIG. 8) in the housing 122. A curved engagement end 310 extends from a second bend 312 formed on the main body 304. The engagement end 310 is displaced from the second bend 312 by an extension portion 314. The engagement end 310 of the retainer 228 engages the groove 170 (FIG. 3) to hold the lamp holder 162 (FIG. 3) in the housing 122. The engagement end 310 of the retainer 228 snaps into the groove 170 on the lamp holder 162 to provide a tactile indication that the lamp holder 162 is fully inserted in the housing 122. The retainer 228 provides a consistent retention force that holds and stabilizes the bulb assembly 120 (FIG. 3) in the housing 122 (FIG. 3) in the harsh, high temperature environment of a vehicle lamp housing 150 (FIG. 2).

Figure 8:
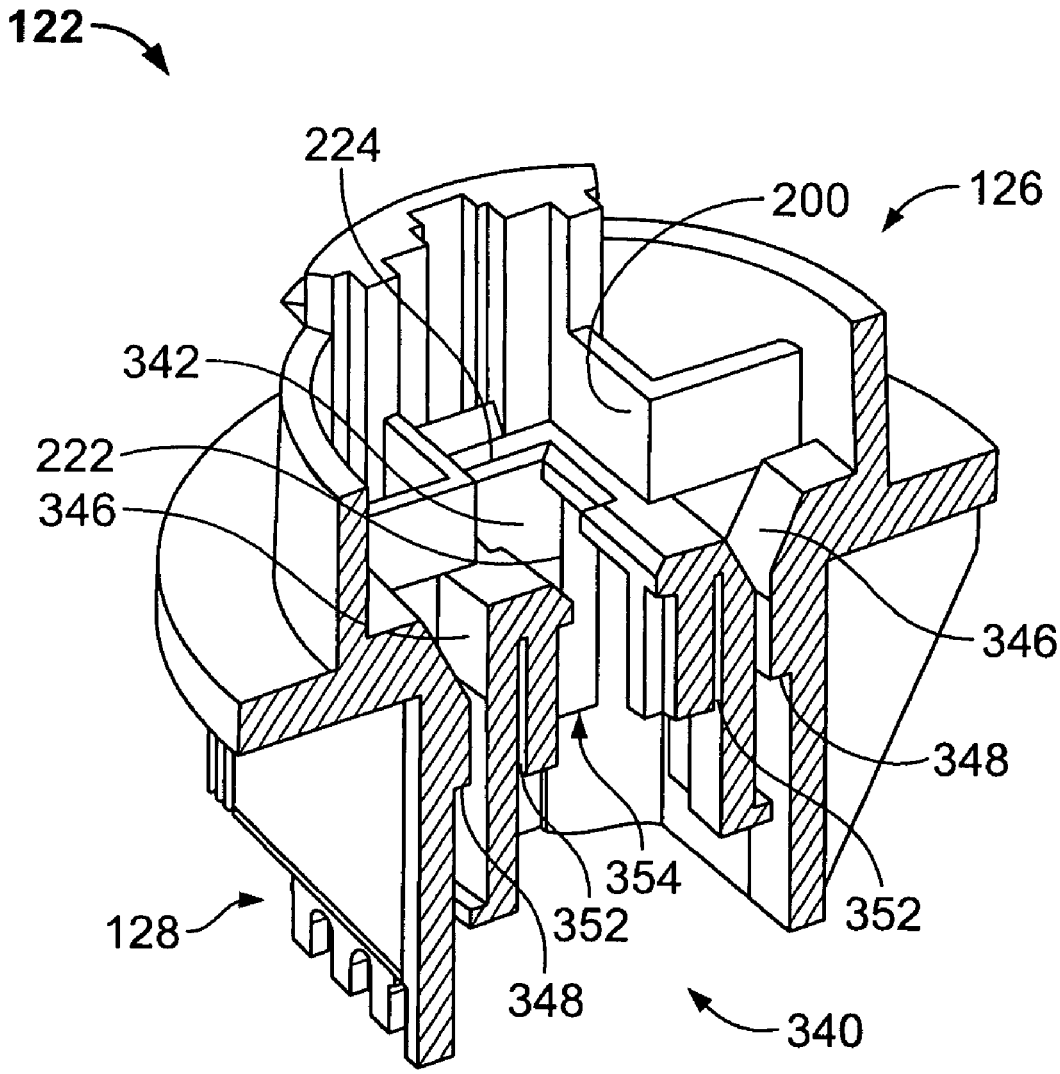
FIG. 8 is a cross sectional view of the socket housing shown in FIG. 3 taken along the line 8—8.

FIG. 8 illustrates a cross sectional view of the socket housing 122. The lamp receptacle 200 is open to a wiring cavity 340 within the wire side 128 of the housing 122 through the bottom opening 222. A contact cavity 342, only one of which is shown in FIG. 8) is formed in the wiring cavity 340 proximate each end wall 224 of the bottom opening 222. The contacts 230, 232, and 234 extend partially into the bottom opening 222 through the contact cavities 342 to receive the lamp extension 180 (FIG. 3) when the lamp holder 162 (FIG. 3) is inserted into the housing 122 as will be described.

Retainer channels 346 receive the retainers 228. Ledges 348 engage tabs 308 on the retainers 228 (FIG. 7) to hold the retainers 228 in the housing 122. Contact receptacles 352 are provided to receive one of the contact walls to mount the contacts 232, 234 in the housing 122. An additional contact receptacle, not visible in FIG. 8, is formed generally at 354 proximate an end of the lamp receptacle to receive the end wall 280 of the ground contact 230 to mount the ground contact 230.

Figure 9:
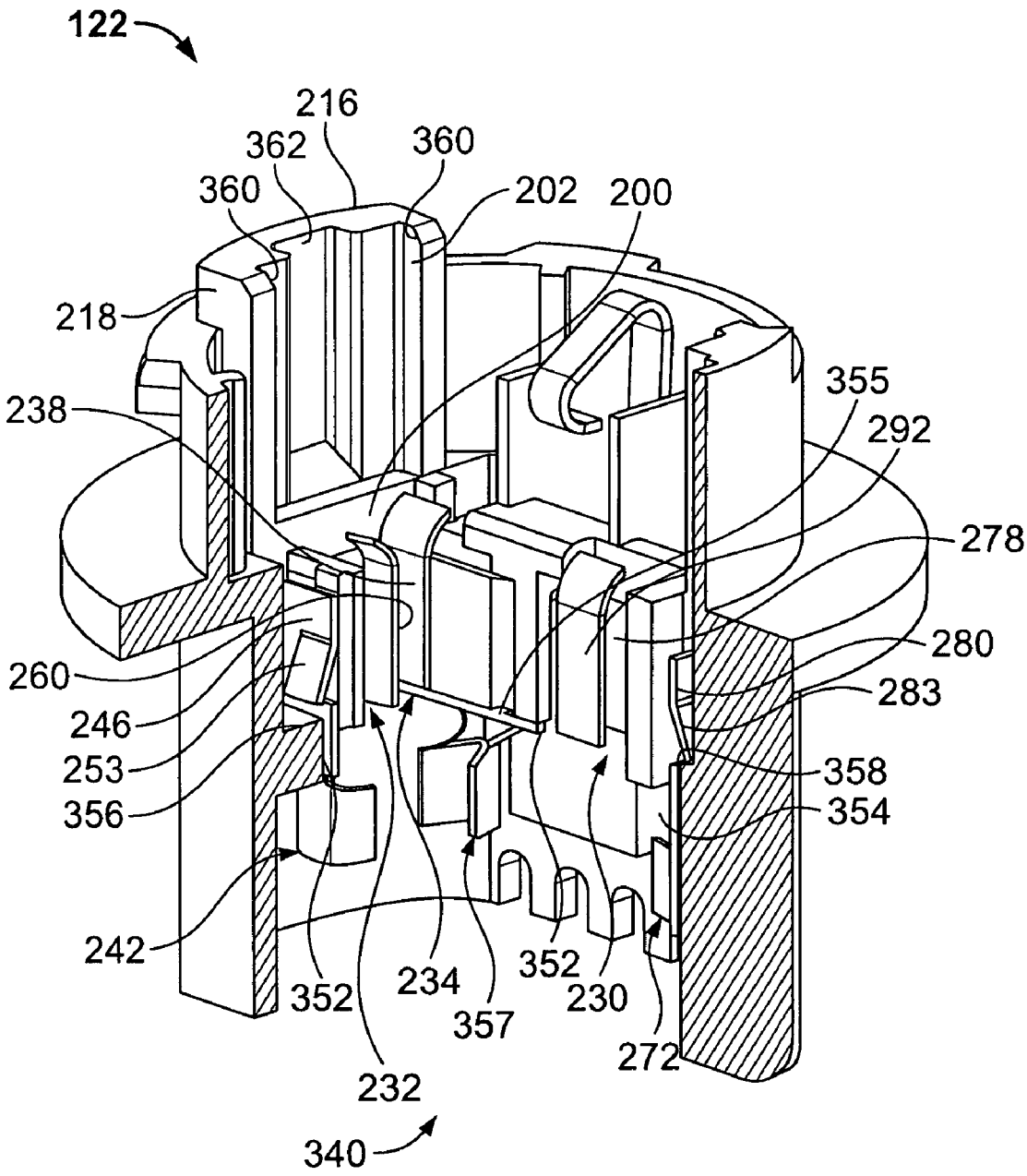
FIG. 9 is a cross sectional view of the socket housing shown in FIG. 3 taken along the line 9—9.

FIG. 9 illustrates a cross sectional view of the socket housing 122 with the contacts 230, 232, and 234 loaded into the socket housing 122. Side wall 264 of the power contact 232 and a side wall 355 of the power contact 234 are received in the contact receptacles 352 such that the contact surfaces 260 and 238 of contacts 232 and 234, respectively, are positioned to engage the surfaces 188 and 189 of the lamp extension 180 (FIG. 3) when the lamp assembly 120 (FIG. 3) is inserted into the socket 122. The tab 253 is positioned to engage a ledge 356 formed in the housing 122 to retain the contact 232 in the housing 122. Similar tab and ledge structures (not shown) are provided to retain the contact 234 adjacent the contact 232. The wire receiving end 242 of the contact 232 and a wire receiving end 357 of the contact 234 extend into the wiring cavity 340 of the housing 122.

The end wall 280 of the ground contact 230 is received in the contact receptacle 354 such that the contact surfaces 292, only one of which is shown in the section of FIG. 9, are positioned to engage the surfaces 188 and 189 of the lamp extension 180 (FIG. 3) when the lamp assembly 120 (FIG. 3) is inserted into the socket 122. The tab 283 is positioned to engage a ledge 358 formed in the housing 122 to retain the ground contact 230 in the housing 122. The wire receiving end 272 of the ground contact 230 extends into the wiring cavity 340 of the housing 122.

The lamp receptacle 200 includes the guide channels 202 and 204, of which only the channel 202 is visible in FIG. 9. The guide channels 202 have an end wall 216 between opposed side walls 218. Each of the side walls 218 include an interior engagement surface 360 that engages the side edges 174 (FIG. 3) of the end panels 164 and 166 (FIG. 3) to retain the lamp holder 162 (FIG. 3) in the lamp receptacle 200. The side edges 174 of the lamp holder 162 slidably engage the interior surfaces 360 of the side walls 218 to assist in retaining and stabilizing the lamp assembly 120 when the lamp holder 162 is inserted in the lamp receptacle 200. The guide channel 204 includes a slot 362 formed in the interior of the end wall 216 and receives the tab 176 on the end panel 164, 166 (FIG. 3) to locate the lamp holder 162 in the lamp receptacle 200. The tab 176 also engages the slot 362 to facilitate the retention of the lamp holder 162 in the lamp receptacle 200.

Figure 10:
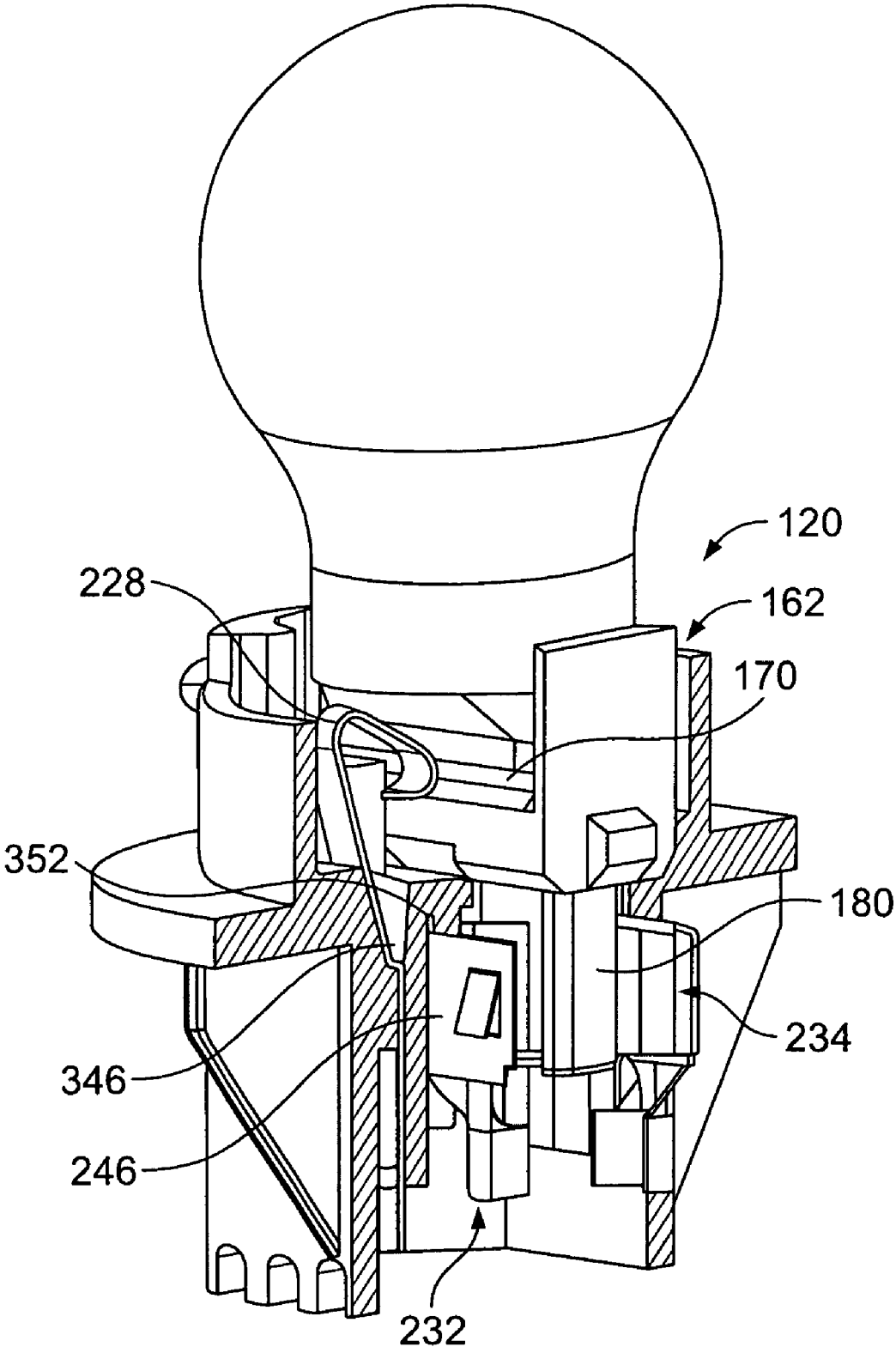
FIG. 10 is a perspective view of a lamp assembly in the housing section shown in FIG. 8.

FIG. 10 is a perspective view of the lamp assembly 120 in the housing section shown in FIG. 8. In FIG. 10, the lamp assembly 120 is seated in the lamp receptacle 200 in the lamp side 126 of the socket housing 122. The wire side 128 of the socket housing 122 includes the wiring cavity 340. The contacts 230, 232, and 234 are mounted in the wiring cavity 340. (Note that the ground terminal contact 230 is hidden from view on FIG. 10.) The side wall 246 of the terminal contact 232 is shown received in the slot 352. The lamp extension 180 extends through the bottom opening 222 to electrically and mechanically engage the terminal contacts 230, 232, and 234. The retainer 228 is received in the retainer channel 346 with the engagement end 310 seated in the groove 170 to retain the lamp holder 162 in the housing 122.

Figure 11:
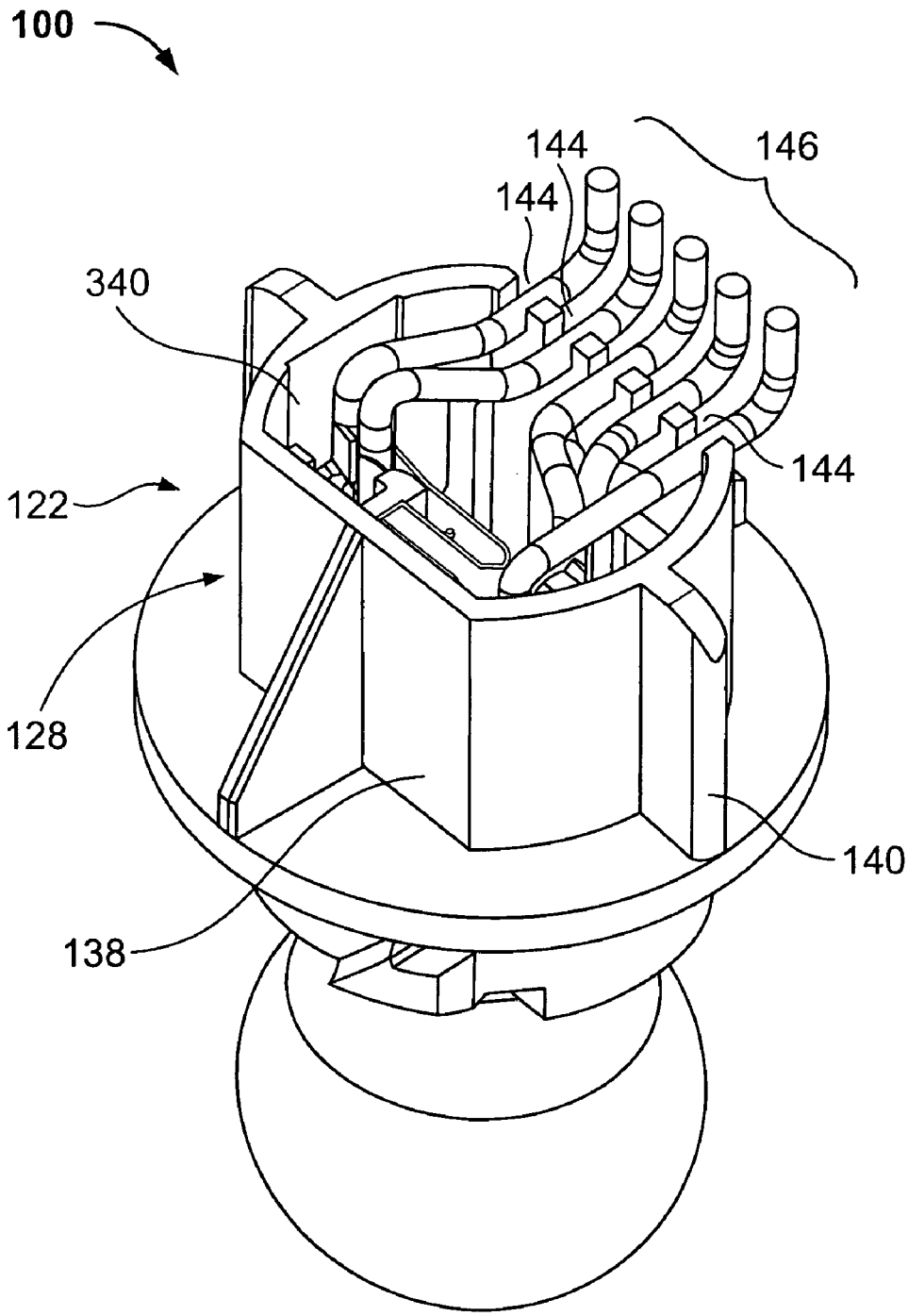
FIG. 11 is a perspective view of the wire side of the lamp and socket assembly shown in FIG. 1.

FIG. 11 is a perspective view of the wire side 128 of the lamp and socket assembly 100. The wire side 128 of the socket housing 122 includes the wiring cavity 340. The wire side outer shell 138 from which the tabs 140 extend forms a wall around the wiring cavity 340. The conductors or wires 146 from the terminal contacts 230, 232, and 234 exit the wiring cavity 340 through the wire guide channels 144. A potting compound may be introduced into the wiring cavity 340 to seal the wiring cavity 340. Sealing the wiring cavity 340 keeps out moisture that could cause corrosion and associated deterioration of the connections between the electrical contacts and the terminal contacts in the socket housing 122. Sealing also provides for the mechanical retention of the wires and some degree of stress protection for the wiring and also of the socket assembly, should someone pull on the wires.

The embodiments thus described provide a lamp socket 100 wherein the terminal contacts 230, 232, 234 establish electrical connections with the lamp 160 and also provide stabilization of the lamp. The contacts include side walls 246, 248, 276, 278 that include engagement sections 258, 290 that support the lamp extension 180. A retainer 228 is provided that engages the lamp holder 162 to retain the lamp holder in the housing 122. The retainer 228 provides tactical feedback to indicate when the lamp holder is fully inserted in the lamp receptacle in the housing.

While the invention has been described in terms of various specific embodiments, those skilled in the art will recognize that the invention can be practiced with modification within the spirit and scope of the claims.

What is claimed is:

1. A lamp socket for holding a lamp assembly, said lamp socket comprising:

a housing having a lamp receiving side and a wire receiving side, said lamp receiving side including a lamp receptacle configured to receive the lamp assembly when inserted in a lamp insertion direction, and said wire receiving side including a contact receptacle; and a contact mounted in said contact receptacle in said housing, said contact including a mating end for electrically and mechanically engaging the lamp assembly, said mating end including a first side wall and an end wall, said first side wall having a planar lamp engagement surface that is joined to said end wall along a bend that extends along a longitudinal axis of said contact, said longitudinal axis extending in a direction non-perpendicular to said insertion direction.

2. The lamp socket of claim 1 wherein said contact further includes a second opposed side wall held in said contact receptacle.

3. The lamp socket of claim 1 wherein said planar lamp engagement surface extends along a vertical plane, the planar lamp engagement surface engaging the lamp assembly continuously along a length of the planar lamp engagement surface in a direction parallel to said longitudinal axis of said contact and to said lamp insertion direction.

4. The lamp socket of claim 1 wherein said contact is loaded into said contact receptacle from said wire receiving side of said housing.

5. The lamp socket of claim 1 further comprising a retainer having a first end mounted in said housing and a second end configured to engage a groove formed in the lamp assembly to retain the lamp assembly in said housing.

6. The lamp socket of claim 1, wherein said contact comprises a ground contact and a pair of power contacts, said ground contact receiving a portion of the lamp within said side walls, said power contacts being positioned adjacent one another so that a portion of the lamp is received between adjacent side walls of the pair of power contacts.

7. A lamp socket for holding a lamp assembly, said lamp socket comprising:

a housing having a lamp receiving side and a wire receiving side, said lamp receiving side including a lamp receptacle configured to receive the lamp assembly when inserted in a lamp insertion direction, and said wire receiving side including a contact receptacle; and a contact mounted in said contact receptacle in said housing, said contact including a mating end and a wire receiving end, said mating end including a first side wall and an end wall, said first side wall having a planar lamp engagement surface that is joined to said end wall along a bend that extends along a longitudinal axis of said contacts, said longitudinal axis extending in a direction non-perpendicular to said lamp insertion direction, one of said side wall and end wall comprising a mounting panel that is received in said contact receptacle to mount said contact, and wherein said mounting panel includes a necked down portion from which said wire receiving end extends.

8. The lamp socket of claim 7 wherein said contact further includes a second opposed side wall held in said contact receptacle.

9. The lamp socket of claim 7 wherein said planar lamp engagement surface extends along a vertical plane, the planar lamp engagement surface engaging the lamp assembly continuously along a length of the planar lamp engagement surface in a direction parallel to said longitudinal axis of said contact and to said lamp insertion direction.

10. The lamp socket of claim 7 further comprising a retainer having a first end mounted in said housing and a second end configured to engage a groove formed in the lamp assembly to retain the lamp assembly in said housing.

11. The lamp socket of claim 7, wherein said contact comprises a ground contact and a pair of power contacts, said ground contact receiving a portion of the lamp within said side walls, said power contacts being positioned adjacent one another so that a portion of the lamp is received between adjacent side walls of the pair of power contacts.

12. A lamp and socket assembly comprising:

a lamp assembly including a lamp holder having an end panel;

a housing having a lamp receiving side and a wire receiving side, said lamp receiving side including a lamp receptacle configured to receive the lamp assembly when inserted in a lamp insertion direction, and said wire receiving side including a contact receptacle; and a contact mounted in said contact receptacle in said housing, said contact including a mating end for electrically and mechanically engaging the lamp assembly, said mating end including a first side wall and an end wall, said first side wall having a planar lamp engagement surface that is joined to said end wall along a bend that extends along a longitudinal axis of said contact, said longitudinal axis extending in a direction non-perpendicular to said insertion direction.

13. The lamp and socket assembly of claim 12 wherein said contact further includes a second opposed side wall held in said contact receptacle.

14. The lamp and socket assembly of claim 12 wherein said planar lamp engagement surface extends along a vertical plane, the planar lamp engagement surface engaging the lamp assembly continuously along a length of the planar lamp engagement surface in a direction parallel to said longitudinal axis of said contact and to said lamp insertion direction.

15. The lamp and socket assembly of claim 12 further comprising a retainer having a first end mounted in said housing and a second end configured to engage a groove formed in said lamp holder to retain the lamp holder in said housing.

16. The lamp and socket assembly of claim 12, wherein said contact includes a tab and said housing includes a ledge, said tab engaging said ledge to retain said contact in said housing.

17. The lamp and socket assembly of claim 12, wherein said contact comprises a ground contact and a pair of power contacts, said ground contact receiving a portion of the lamp within said side walls, said power contacts being positioned adjacent one another so that a portion of the lamp is received between adjacent side walls of the pair of power contacts.

18. The lamp and socket assembly of claim 12, wherein said lamp receptacle includes an end wall having a guide channel and a slot formed therein and said end panel includes side edges, said guide channel being configured to engage said side edges of said end panel of said lamp holder.

19. The lamp and socket assembly of claim 12, wherein said lamp receptacle includes an end wall having a guide channel and a slot formed therein to orient said lamp holder in said housing, and said end panel of said lamp holder includes a protrusion extending therefrom, said slot being configured to receive said protrusion.

* * * * *